US010758792B2

(12) United States Patent
Shimahara

(10) Patent No.: US 10,758,792 B2
(45) Date of Patent: Sep. 1, 2020

(54) IRON TYPE GOLF CLUB HEAD

(71) Applicant: Sumitomo Rubber Industries, Ltd., Hyogo (JP)

(72) Inventor: Yuki Shimahara, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/236,135

(22) Filed: Dec. 28, 2018

(65) Prior Publication Data

US 2019/0224536 A1 Jul. 25, 2019

(30) Foreign Application Priority Data

Jan. 24, 2018 (JP) ..... 2018-009400

(51) Int. Cl.
*A63B 53/04* (2015.01)
*A63B 53/00* (2015.01)

(52) U.S. Cl.
CPC ..... *A63B 53/047* (2013.01); *A63B 53/0475* (2013.01); *A63B 2053/005* (2013.01); *A63B 2053/0408* (2013.01); *A63B 2053/0462* (2013.01); *A63B 2053/0479* (2013.01)

(58) Field of Classification Search
CPC ..... A63B 53/047; A63B 2053/005; A63B 2053/0462; A63B 2053/0408; A63B 2053/0479; A63B 53/0475
See application file for complete search history.

(56) References Cited

U.S. PATENT DOCUMENTS 2,254,528 A * 9/1941 Hoare ..... A63B 53/047 473/328
D241,359 S * 9/1976 Taylor ..... D21/748
D276,644 S * 12/1984 Solheim ..... D21/748
4,826,172 A * 5/1989 Antonious ..... A63B 53/04 473/350
4,915,386 A * 4/1990 Antonious ..... A63B 53/04 473/350
D327,109 S * 6/1992 Hardman ..... D21/748
5,377,985 A * 1/1995 Ohnishi ..... A63B 60/00 473/324

(Continued)

FOREIGN PATENT DOCUMENTS

JP H08-000774 A 1/1996
JP 2000-084122 A 3/2000

(Continued)

*Primary Examiner* — Stephen L Blau
(74) *Attorney, Agent, or Firm* — Studebaker & Brackett PC

(57) ABSTRACT

A head includes a face surface, a back surface, and a top blade. The back surface includes a top-side region and a sole-side region. The top-side region includes a toe recess part located on a toe side relative to a face center, a heel recess part located on a heel side relative to the face center, and a first thick portion extending along the top blade and located on an upper side relative to the toe recess part and the heel recess part. In a reference state in which the head is placed on a horizontal plane, an angle between a lower edge of the first thick portion and the horizontal plane is denoted by θ1, and an angle between the top blade and the horizontal plane is denoted by θ2. The angle θ1 is smaller than the angle θ2.

15 Claims, 13 Drawing Sheets

(56) References Cited

U.S. PATENT DOCUMENTS

| | | | | | |
|---|---|---|---|---|---|
| 5,429,353 | A * | 7/1995 | Hoeflich | A63B 53/04 473/350 |
| D362,884 | S * | 10/1995 | Blough | D21/750 |
| D362,885 | S * | 10/1995 | Blough | D21/747 |
| D364,435 | S * | 11/1995 | Wood | D21/750 |
| D368,753 | S * | 4/1996 | Blough | D21/750 |
| D370,514 | S * | 6/1996 | Blough | D21/750 |
| 5,540,436 | A * | 7/1996 | Boone | A63B 53/00 473/350 |
| 5,547,194 | A * | 8/1996 | Aizawa | A63B 53/04 473/350 |
| 5,658,208 | A | 8/1997 | Shimasaki | |
| D387,113 | S * | 12/1997 | Burrows | D21/748 |
| D392,356 | S * | 3/1998 | Burrows | D21/748 |
| 5,792,005 | A * | 8/1998 | Sieleman | A63B 53/04 473/349 |
| D411,272 | S * | 6/1999 | Burrows | D21/748 |
| D421,080 | S * | 2/2000 | Chen | D21/747 |
| D489,106 | S * | 4/2004 | Wahl | D21/749 |
| 6,719,642 | B2 * | 4/2004 | Wahl | A63B 53/04 473/291 |
| D497,963 | S * | 11/2004 | Toulon | D21/747 |
| 6,849,005 | B2 | 2/2005 | Rife | |
| D584,370 | S * | 1/2009 | Cleveland | D21/747 |
| D584,371 | S * | 1/2009 | Chick | D21/759 |
| D586,414 | S * | 2/2009 | Foster | D21/747 |
| D587,327 | S * | 2/2009 | Ines | D21/747 |
| D619,667 | S * | 7/2010 | Cleveland | D21/747 |
| D691,685 | S * | 10/2013 | Cyrulik | D21/759 |
| D719,627 | S * | 12/2014 | Wieland | D21/759 |
| D832,952 | S * | 11/2018 | Milleman | D21/747 |
| 10,478,684 | B2 * | 11/2019 | Parsons | A63B 53/047 |
| 2002/0082118 | A1 * | 6/2002 | Iwata | A63B 53/04 473/349 |
| 2006/0234806 | A1 | 10/2006 | Gilbert et al. | |
| 2009/0023513 | A1 | 1/2009 | Shibata et al. | |
| 2012/0289360 | A1 * | 11/2012 | Breier | A63B 53/047 473/335 |
| 2014/0302944 | A1 * | 10/2014 | Roach | A63B 53/047 473/332 |
| 2016/0184669 | A1 * | 6/2016 | Deshmukh | A63B 53/0475 473/335 |
| 2019/0351296 | A1 * | 11/2019 | Honea | A63B 53/047 |

FOREIGN PATENT DOCUMENTS

| | | | |
|---|---|---|---|
| JP | 2006-289105 | A | 10/2006 |
| JP | 2008-279249 | A | 11/2008 |
| JP | 2014030588 | A | 2/2014 |
| JP | 1531509 | S | 8/2015 |

* cited by examiner

IRON TYPE GOLF CLUB HEAD

The present application claims priority on Patent Application No. 2018-009400 filed in JAPAN on Jan. 24, 2018. The entire contents of this Japanese Patent Application are hereby incorporated by reference.

BACKGROUND OF THE INVENTION

Field of the Invention

The present invention relates to an iron type golf club head.

Description of the Related Art

As iron type golf club heads, a flat back iron and a cavity back iron have been known.

JP8-774A discloses an iron head that has almost the same center-of-gravity distance as that of an ordinary flat back iron, and that has the same moment of inertia as that of an ordinary cavity back iron.

SUMMARY OF THE INVENTION

The present inventor has found that there is room to improve a conventional iron type golf club head.

It is an object of the present disclosure to provide an iron type golf club head having an excellent hit feeling and capable of suppressing variations in flight distances.

In one aspect, an iron type golf club head includes a face surface, a back surface, a sole surface, and a top blade. The back surface includes a top-side region and a sole-side region located between the top-side region and the sole surface. The top-side region includes: a toe recess part located on a toe side relative to a face center; a heel recess part located on a heel side relative to the face center; and a first thick portion extending along the top blade, located on an upper side of the toe recess part, and located on an upper side of the heel recess part. In a reference state in which the head is placed on a horizontal plane, an angle between a lower edge of the first thick portion and the horizontal plane is denoted by θ1, and an angle between the top blade and the horizontal plane is denoted by θ2. The angle θ1 is smaller than the angle θ2.

In another aspect, a second thick portion may be formed between the toe recess part and the heel recess part. The second thick portion may be located in a region that includes a sweet spot.

In another aspect, the toe recess part may reach a toe-side edge of the head, and a side recess part may be formed on a toe side surface of the head by the reaching of the toe recess part. The side recess part may be invisible when the head in the reference state is viewed from a reference viewpoint located vertically above the head.

In another aspect, the toe recess part may include a toe upper-side surface formed along a lower edge of the first thick portion. The toe upper-side surface may include a toe upper inclined surface that is inclined so as to approach the face surface as going to a lower side.

In another aspect, a center recess part may be formed between the toe recess part and the heel recess part. The toe recess part, the heel recess part, and the center recess part may be continuous with each other to form a continuous recess part that extends from the toe side to the heel side.

In another aspect, a head thickness of the first thick portion is denoted by Tc1 (mm), a minimum value of a head thickness of the toe recess part is denoted by Tc3 (mm), and a minimum value of a head thickness of the heel recess part is denoted by Tc4 (mm). A difference [Tc1−Tc3] may be greater than or equal to 2.0 mm. A difference [Tc1−Tc4] may be greater than or equal to 2.0 mm.

BRIEF DESCRIPTION OF THE DRAWINGS

FIG. 3A is a shaded view;

FIG. 4 is a shaded view;

FIG. 5 is a shaded view;

DESCRIPTION OF THE PREFERRED EMBODIMENTS

Hereinafter, embodiments will be described in detail with appropriate references to the accompanying drawings.

Definitions of Terms

Terms appeared in the present application are defined as follows.

[Reference State]

The reference state is a state where a head is placed on a horizontal plane HP in a state where the horizontal plane HP and a face line gv are parallel to each other. In the reference state, a center axis line Z (shaft axis line Z) of a shaft hole of the head is disposed in a reference perpendicular plane VP (see FIG. 13). The reference perpendicular plane VP is a plane perpendicular to the horizontal plane HP. In the reference state, the face line gv is parallel to the horizontal plane HP, and parallel to the reference perpendicular plane VP.

[Toe-Heel Direction]

Figure 13:
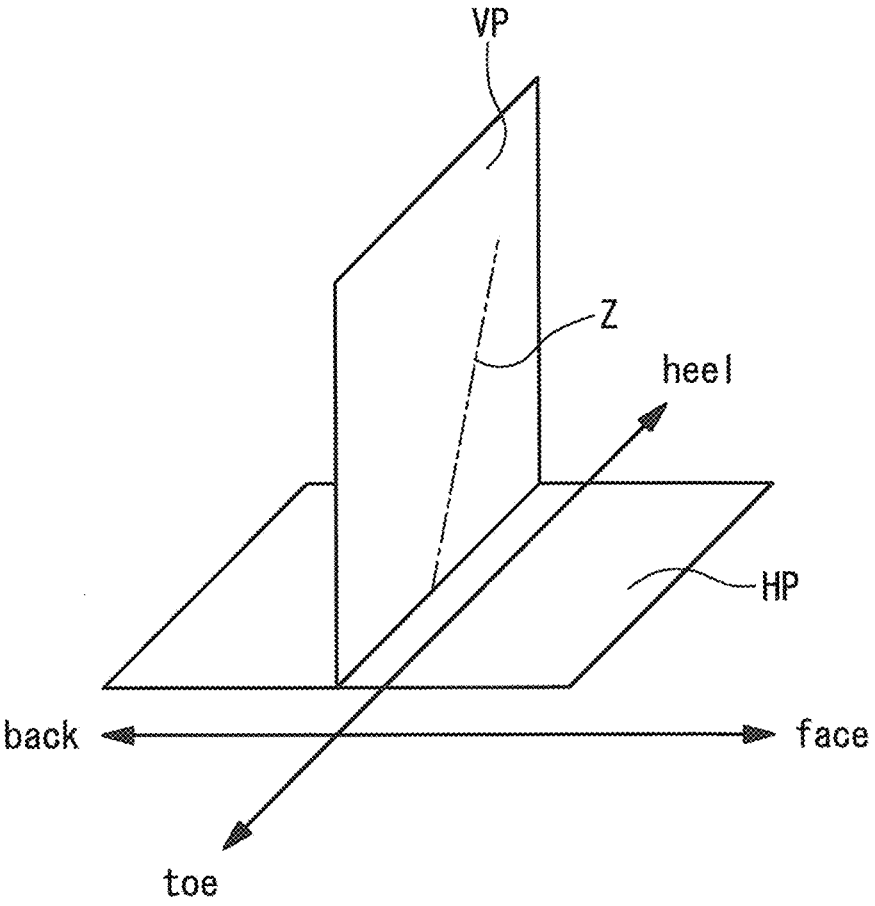
FIG. 13 is a diagram illustrating a reference state.

In the head of the reference state, the direction of an intersectional line between the reference perpendicular plane VP and the horizontal plane HP is the toe-heel direction (see FIG. 13). The toe-heel direction is parallel to the face line gv.

[Face-Back Direction]

A direction perpendicular to the toe-heel direction and parallel to the horizontal plane HP is the face-back direction (see FIG. 13). The face-back direction is also a front-rear direction. A face side is also referred to as a front side.

[Up-Down Direction]

A direction perpendicular to the toe-heel direction and perpendicular to the face-back direction is the up-down direction.

[Middle Position Pc of Face Line]

The middle position of a longest face line gv1 in the toe-heel direction is a middle position Pc of the face line (see FIG. 2 to be described later). The middle position Pc is a position in the toe-heel direction. When a plurality of longest face lines gv1 are present, the middle position Pc is determined based on the lowermost longest face line gv1.

[Face Center Fc]

On the middle position Pc of the face line, a center of the up-down direction width of the face is determined. The center is the face center Fc (see FIG. 2 to be described later).

[Toe Reference Position Pt]

The position of a toe-side end of the longest face line gv1 is a toe reference position Pt (see FIG. 2 to be described later). The toe reference position Pt is a position in the toe-heel direction. When the plurality of longest face lines gv1 are present, the toe reference position Pt is determined based on the lowermost longest face line gv1.

[Heel Reference Position Ph]

The position of a heel-side end of the longest face line gv1 is a heel reference position Ph (see FIG. 2 to be described later). The heel reference position Ph is a position in the toe-heel direction. When the plurality of longest face lines gv1 are present, the heel reference position Ph is determined based on the lowermost longest face line gv1.

[Sweet Spot SS]

The sweet spot SS is an intersection point between the face surface and a straight line passing through a center of gravity of the head and perpendicular to the face surface.

Figure 1:
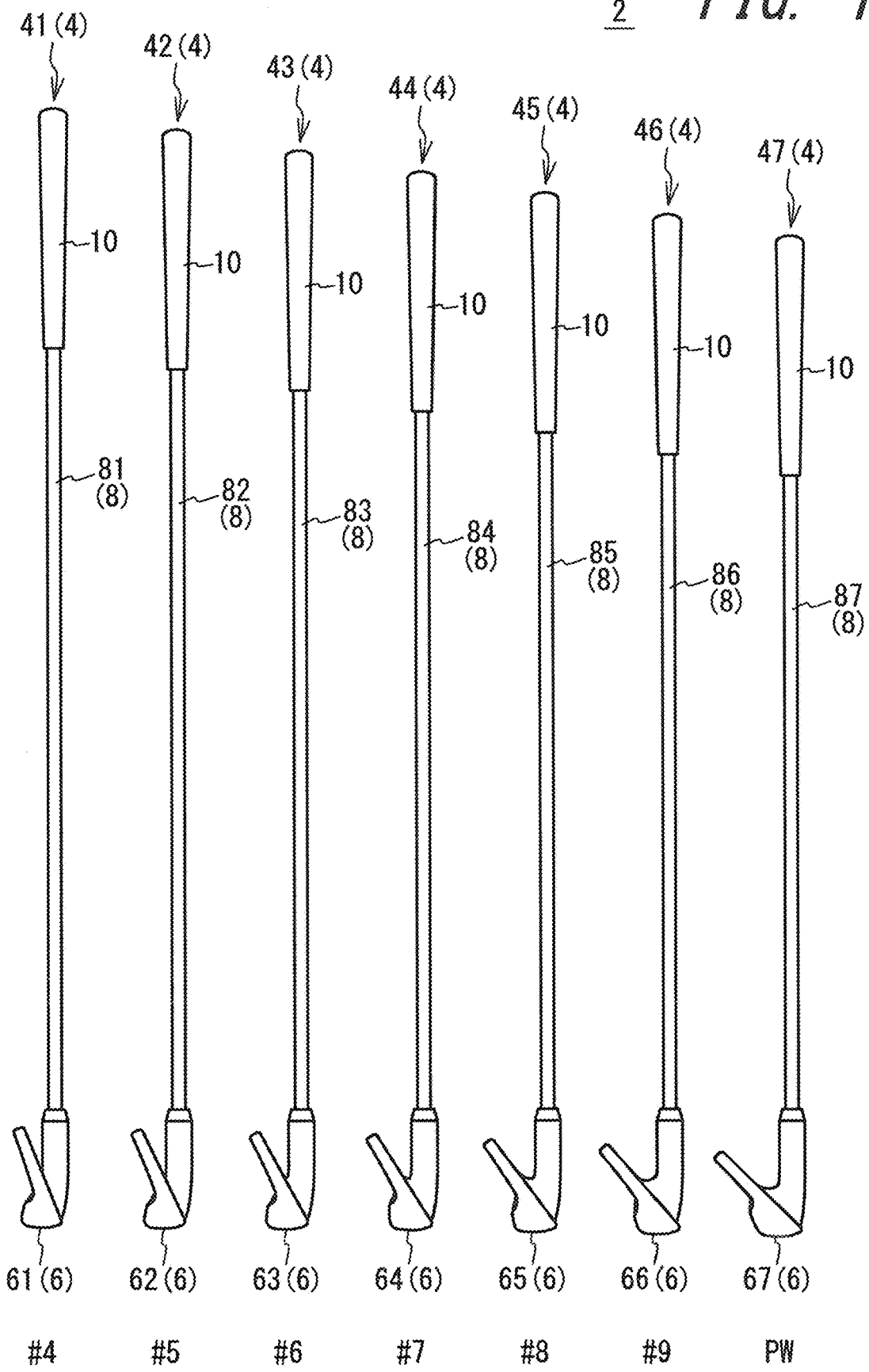
FIG. 1 shows an iron set including a head according to a first embodiment.

FIG. 1 shows a golf club set 2 according to a first embodiment. The set 2 includes a plurality of golf clubs 4. In the present embodiment, the set 2 includes seven golf clubs 4. The set 2 includes a first golf club 41, a second golf club 42, a third golf club 43, a fourth golf club 44, a fifth golf club 45, a sixth golf club 46, and a seventh golf club 47.

The set 2 includes the plurality of golf clubs 4 having different loft angles. In the set 2, the club length is decreased as the loft angle is increased. The loft angle means a real loft angle. The real loft angle means a loft angle with respect to the shaft axis line.

The number of the clubs of the set 2 is greater than or equal to 2. In the set 2, the number of the clubs is 7. Advantageous effects to be described later are effective in all the club numbers. In this respect, the number of the clubs of the set 2 is preferably greater than or equal to 3, more preferably greater than or equal to 4, and still more preferably greater than or equal to 5. In the golf rules, the number of clubs capable of being used during play is limited. In this respect, the number of the clubs of the set 2 is preferably less than or equal to 10, more preferably less than or equal to 9, and still more preferably less than or equal to 8.

Each of the golf clubs 4 includes a head 6, a shaft 8, and a grip 10. The first golf club 41 includes a head 61, a shaft 81, and a grip 10. The second golf club 42 includes a head 62, a shaft 82, and a grip 10. The third golf club 43 includes a head 63, a shaft 83, and a grip 10. The fourth golf club 44 includes a head 64, a shaft 84, and a grip 10. The fifth golf club 45 includes a head 65, a shaft 85, and a grip 10. The sixth golf club 46 includes a head 66, a shaft 86, and a grip 10. The seventh golf club 47 includes a head 67, a shaft 87, and a grip 10. In the set 2, the length of the shaft 8 is changed in accordance with club length. The grips 10 of all the club numbers are the same.

The first golf club 41 is a 4-iron. The second golf club 42 is a 5-iron. The third golf club 43 is a 6-iron. The fourth golf club 44 is a 7-iron. The fifth golf club 45 is an 8-iron. The sixth golf club 46 is a 9-iron. The seventh golf club 47 is a pitching wedge. These club numbers are shown as merely an example. The club number of the head 6 is not limited. Note that the present invention is directed to a single head, and thus needs not be a set.

Hereinafter, the head 6 (head 61) of the 4-iron is shown as an example. However, the following description applies to all the head 6 (heads 61 to 67).

Figure 2:
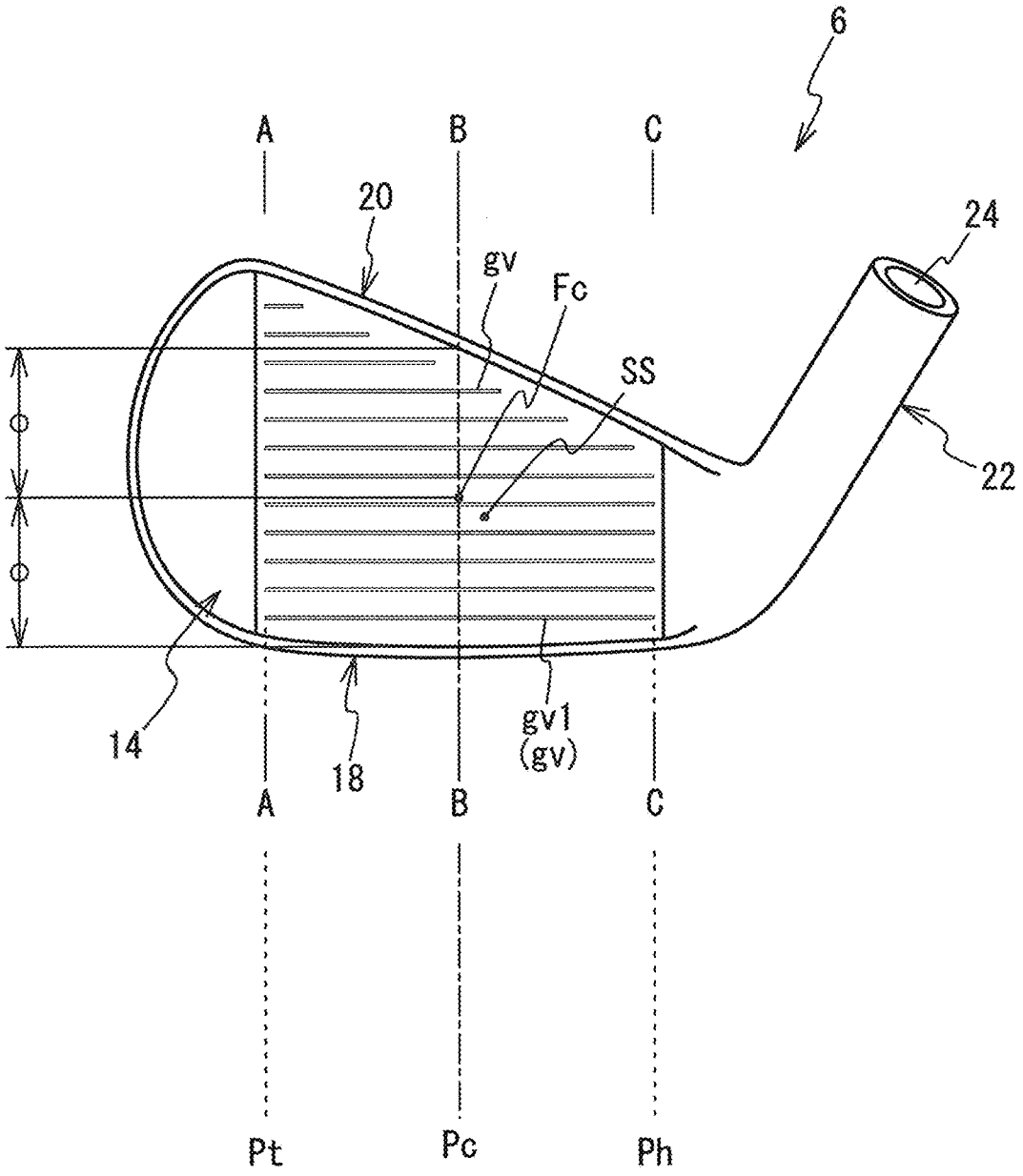
FIG. 2 is a front view of the head according to the first embodiment, as viewed from the front of a face.
Figure 3A:
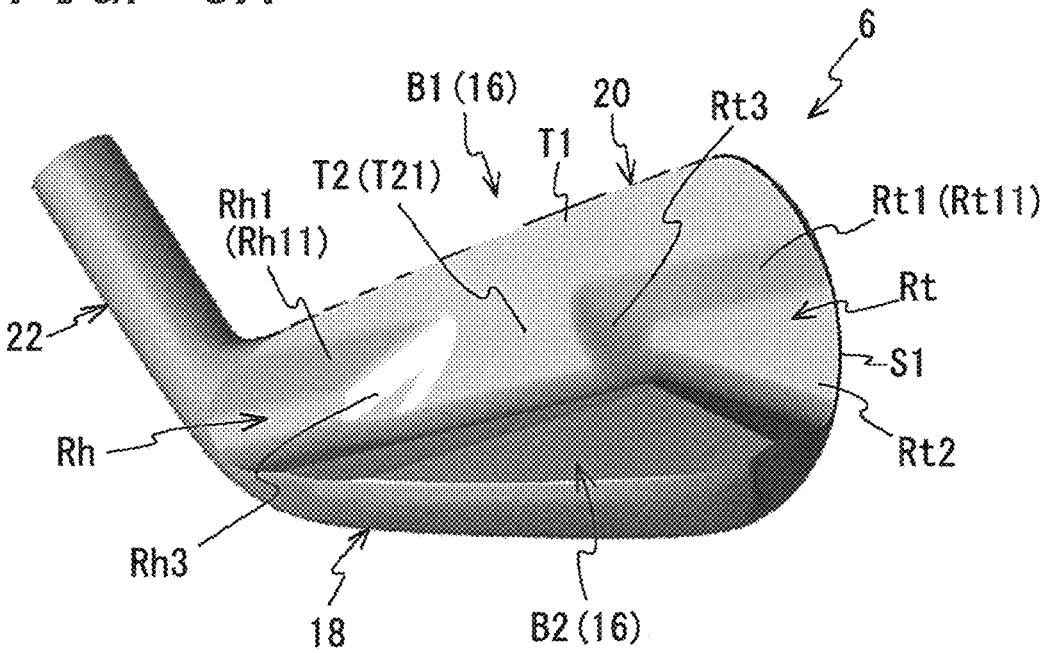
FIG. 3A and FIG. 3B are back views of the head in FIG. 2.
Figure 3B:
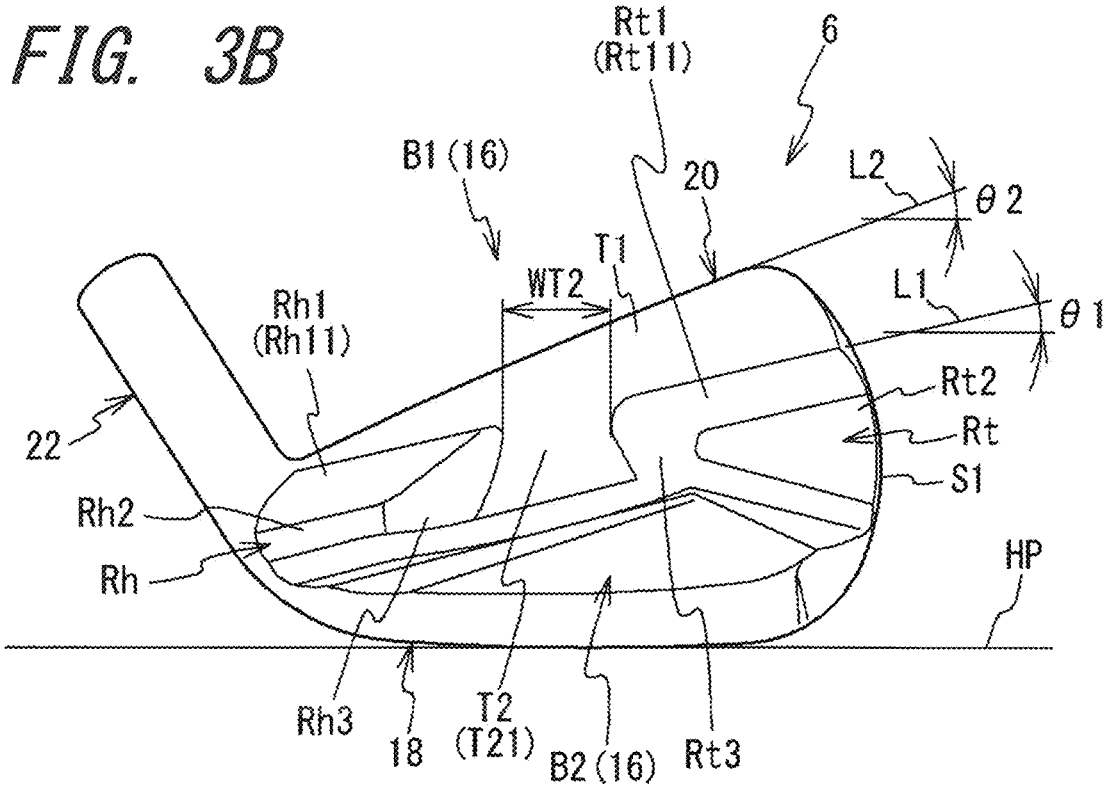
Figure 4:
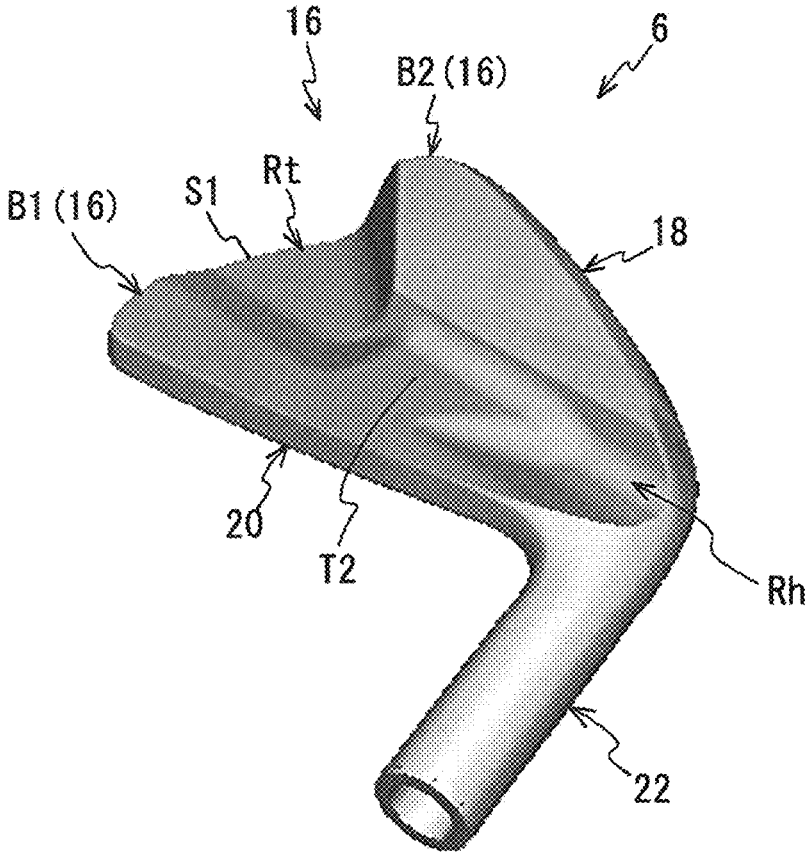
FIG. 4 is a perspective view of the head in FIG. 2.
Figure 5:
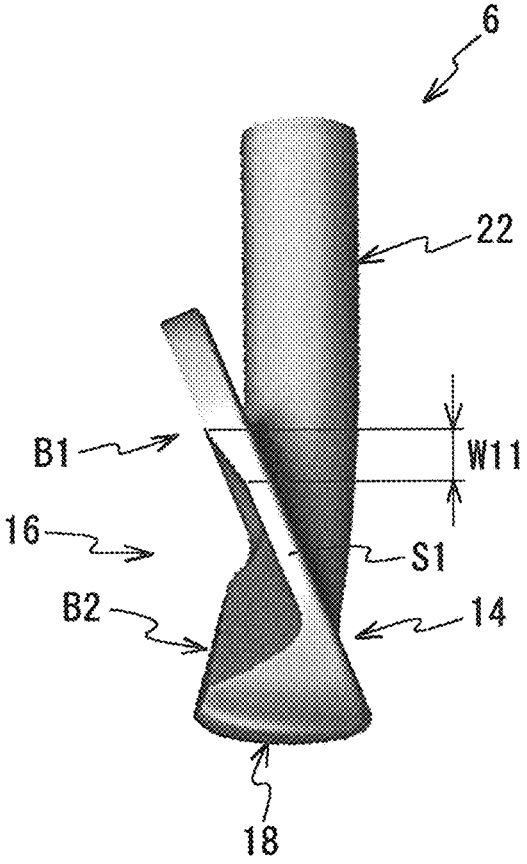
FIG. 5 is a side view of the head in FIG. 2 as viewed from a toe side.

FIG. 2 is a front view of the head 6 as viewed from a direction perpendicular to a face surface thereof. FIG. 3A is a shaded view showing a back surface of the head 6. In FIG. 3A, unevenness is shown by shading. FIG. 3B is a back view of the head 6. The unevenness of the back surface of the head 6 is hard to depict only by a line drawing such as FIG. 3B. For this reason, FIG. 3A is shown in addition to a usual drawing (FIG. 3B). FIG. 4 is a perspective view of the head 6 as viewed from an obliquely rear side, and FIG. 5 is a side view of the head 6 as viewed from the toe side. These FIG. 4 and FIG. 5 are also shaded views.

As shown in FIG. 2 to FIG. 5, the head 6 includes a face surface 14, aback surface 16, a sole surface 18, and a top blade 20. The head 6 further includes a hosel 22. The hosel 22 includes a shaft hole 24.

The face surface 14 includes a plurality of face lines gv. The face lines gv include a longest face line gv1. The longest face line gv in the plurality of face lines gv is the longest face line gv1.

If the face lines gv are disregarded, the face surface 14 is a plane. Therefore, in the present application, the face surface 14 is treated as a plane.

The description of the face lines gv is omitted except for FIG. 2.

As described above, the middle position Pc of the face line, the toe reference position Pt and the heel reference position Ph are defined based on the longest face line gv1 (see FIG. 2).

The face surface 14 includes the face center Fc. As described above, the face center Fc is the center of the up-down direction width of the face surface 14 in the middle position Pc of the face line.

The face surface 14 includes the sweet spot SS. In the present embodiment, the sweet pot SS is located on the heel side relative to the face center Fc. In the present embodiment, the sweet spot SS is located on the lower side relative to the face center Fc.

The face surface 14 is a hitting face. A ball collides against the face surface 14 at impact.

The back surface 16 is a surface opposite to the face surface 14. The back surface 16 is also referred to as a back face.

The sole surface 18 constitutes a lower surface of the head 6. The sole surface 18 is located on the lower side of the face surface 14. The sole surface 18 is located on the lower side of the back surface 16. The sole surface 18 extends between a lower edge of the face surface 14 and a lower edge of the back surface 16.

The top blade 20 constitutes an upper surface of the head 6. The top blade 20 is located on the upper side of the face surface 14. The top blade 20 is located on the upper side of the back surface 16. The top blade 20 extends between an upper edge of the face surface 14 and an upper edge of the back surface 16.

The back surface 16 includes a top-side region B1 and a sole-side region B2. The top-side region B1 is located on the upper side of the sole-side region B2. The top-side region B1 is located between the sole-side region B2 and the top blade 20. The sole-side region B2 is located on the lower side of the top-side region B1. The sole-side region B2 is located between the top-side region B1 and the sole surface 18.

In the head 6, a head lower portion that is continuous with the sole has a large thickness. The head lower portion is included in the sole-side region B2. On the other hand, a head upper portion that is located on the upper side relative to the head lower portion has a small thickness as compared with the head lower portion. The head upper portion is included in the top-side region B1.

A boundary between the top-side region B1 and the sole-side region B2 may be determined based on head thickness. For example, a location (a contour line) having a head thickness of 7.0 mm may be the boundary between the top-side region B1 and the sole-side region B2. The sole-side region B2 includes a portion having a head thickness larger than the maximum value of the head thickness in the top-side region B1. When the maximum value of the head thickness in a first thick portion T1 and a second thick portion T2 to be described later is denoted by Tmax, a region having a head thickness larger than Tmax may be defined as the sole-side region B2. When the head does not include the second thick portion T2, the maximum value of the head thickness in the first thick portion T1 can be Tmax.

The maximum value of the head thickness in the sole-side region B2 is preferably greater than or equal to 10 mm, more preferably greater than or equal to 13 mm, and still more preferably greater than or equal to 15 mm. In view of restriction on head weight, the maximum value of the head thickness in the sole-side region B2 is preferably less than or equal to 25 mm.

In the present application, "thickness" means the head thickness. The thickness is measured along a direction perpendicular to the face surface 14.

In general, the type of the back surface of an iron head is broadly classified into a cavity back or a flat back. The cavity back might be further classified into an undercut cavity (pocket cavity) or the remainder. The flat back is also referred to as a muscle back.

The back surface 16 of the head 6 is not the cavity back. The back surface 16 of the head 6 is the flat back. In other words, the back surface 16 of the head 6 is the muscle back. Note that the "flat back" means that the back surface is similar to a plane as compared to the cavity back, and does not mean that the whole back surface is flat.

In general, the definition of the cavity back iron is not necessarily clear. In this respect, the present invention does not exclude the cavity back iron.

A typical cavity back iron includes the following structure (a). The head 6, however, does not include the structure (a).

(a) A cavity is provided on the back surface; the cavity is located in a region including the sweet spot SS; and the whole circumference of the cavity is surrounded by a thick portion having a head thickness greater than that of the cavity.

A typical cavity back iron includes the following structure (b). The head 6 according to the present embodiment, however, does not include the structure (b).

(b) A cavity is provided on the back surface; the bottom surface of the cavity is formed by a constant thickness portion in which the head thickness is constant; and the constant thickness portion has an area of greater than or equal to 500 $mm^2$.

A typical cavity back includes the following structure (c). The head 6, however, does not include the structure (c).

(c) A cavity is provided on the back surface; the bottom surface of the cavity is formed by a constant thickness portion in which the head thickness is constant; and the constant thickness portion is located in a region including the sweet spot SS and the face center Fc.

A typical cavity back includes the following structure (d). The head 6, however, does not include the structure (d).

(d) In the above structure (b), the head thickness of the constant thickness portion is greater than or equal to 1.5 mm and less than or equal to 3 mm.

A typical cavity back includes the following structure (e). The head 6, however, does not include the structure (e).

(e) In the above structure (c), the head thickness of the constant thickness portion is greater than or equal to 1.5 mm and less than or equal to 3 mm.

As shown in FIG. 3A and FIG. 3B, the top-side region B1 (back surface 16) includes a toe recess part Rt and a heel recess part Rh.

The toe recess part Rt is located on the toe side relative to the face center Fc. The toe recess part Rt is located in a region including the toe reference position Pt. The toe recess part Rt is located in a region that does not include the heel reference position Ph.

The toe recess part Rt reaches a toe-side edge of the head 6 (back surface 16). In other words, a toe-side edge of the toe recess part Rt constitutes a part of the edge of the head 6. As shown in FIG. 5, the side surface of the head 6 is narrowed in the portion to which the toe recess part Rt reaches. The toe recess part Rt reaches the toe-side edge of the head 6, thereby forming a side recess part S1 on the toe side surface of the head 6. The side recess part S1 is a portion in which the toe side surface of the head 6 is partially narrowed (see FIG. 5).

The heel recess part Rh is located on the heel side relative to the face center Fc. The heel recess part Rh is located in a region including the heel reference position Ph. The heel recess part Rh is located in a region that does not include the toe reference position Pt.

The heel recess part Rh reaches a heel-side edge of the back surface 16. In other words, a heel-side edge of the heel recess part Rh constitutes a part of the edge of the back surface 16.

As shown in FIG. 3A and FIG. 3B, the top-side region B1 (back surface 16) includes the first thick portion T1. The first thick portion T1 extends along the top blade 20. The first thick portion T1 is adjacent to the top blade 20. The upper edge of the first thick portion T1 is the top blade 20.

A part of the first thick portion T1 is located on the upper side of the toe recess part Rt. The toe recess part Rt is located between the first thick portion T1 and the sole-side region B2. The head thickness of the first thick portion T1 is greater than the head thickness of the toe recess part Rt.

A part of the first thick portion T1 is located on the upper side of the heel recess part Rh. The heel recess part Rh is located between the first thick portion T1 and the sole-side region B2. The head thickness of the first thick portion T1 is greater than the head thickness of the heel recess part Rh.

As shown in FIG. 3A and FIG. 3B, the top-side region B1 (back surface 16) includes the second thick portion T2. The second thick portion T2 is located on the toe side relative to the heel recess part Rh. The second thick portion T2 is located on the heel side relative to the toe recess part Rt. The second thick portion T2 is formed between the toe recess part Rt and the heel recess part Rh.

The second thick portion T2 is located in a region including the sweet spot SS (see FIG. 2). In other words, a straight line passing through the center of gravity of the head and perpendicular to the face surface 14 passes through the second thick portion T2.

The second thick portion T2 is located in a region including the face center Fc. The second thick portion T2 is located in a region that does not include the toe reference position Pt. The second thick portion T2 is located in a region that does not include the heel reference position Ph.

The head thickness of the second thick portion T2 is greater than the head thickness of the toe recess part Rt. The head thickness of the second thick portion T2 is greater than the head thickness of the heel recess part Rh.

As shown in FIG. 3A and FIG. 3B, the second thick portion T2 includes a width changing portion T21 that has a width increasing toward the sole surface 18. In the head 6, the whole second thick portion T2 is the width changing portion T21. A part of the second thick portion T2 may be the width changing portion T21.

As shown in FIG. 3A and FIG. 3B, the first thick portion T1 and the second thick portion T2 are continuous with each other without a step.

In FIG. 3B, an angle θ1 and an angle θ2 are shown. In the reference state, an angle between the lower edge of the first thick portion T1 and the horizontal plane HP is denoted by θ1. The angle θ1 is an angle formed by a straight line L1 extending along the lower edge of the first thick portion T1 and the horizontal plane HP. In the reference state, an angle between the top blade 20 and the horizontal plane HP is denoted by θ2. The angle θ2 is an angle formed by a straight line L2 extending along the top blade 20 and the horizontal plane HP. In the head 6, the angle θ1 is smaller than the angle θ2.

When the lower edge of the first thick portion T1 is formed along a curved line, the straight line L1 is a tangent line of the curved line. In this case, the direction of the straight line L1 is changed depending on the point of contact, whereby the angle θ1 is also changed. Therefore, in this case, the angle θ1 has a maximum value θ1max and a minimum value θ1min. When the top blade 20 is formed along a curved line, the straight line L2 is a tangent line of the curved line. In this case, the direction of the straight line L2 is changed depending on the point of contact, whereby the angle θ2 is also changed. Therefore, in this case, the angle θ2 has a maximum value θ2max and a minimum value θ2min. Preferably, θ1max is smaller than θ2min. In the present application, "θ1<θ2" can mean "θ1max<θ2 min".

As shown in FIG. 3A and FIG. 3B, the first thick portion T1 has an up-down direction width that increases toward the toe side. A weight distributed to the first thick portion T1 is increased by the increased up-down direction width.

Figure 6:
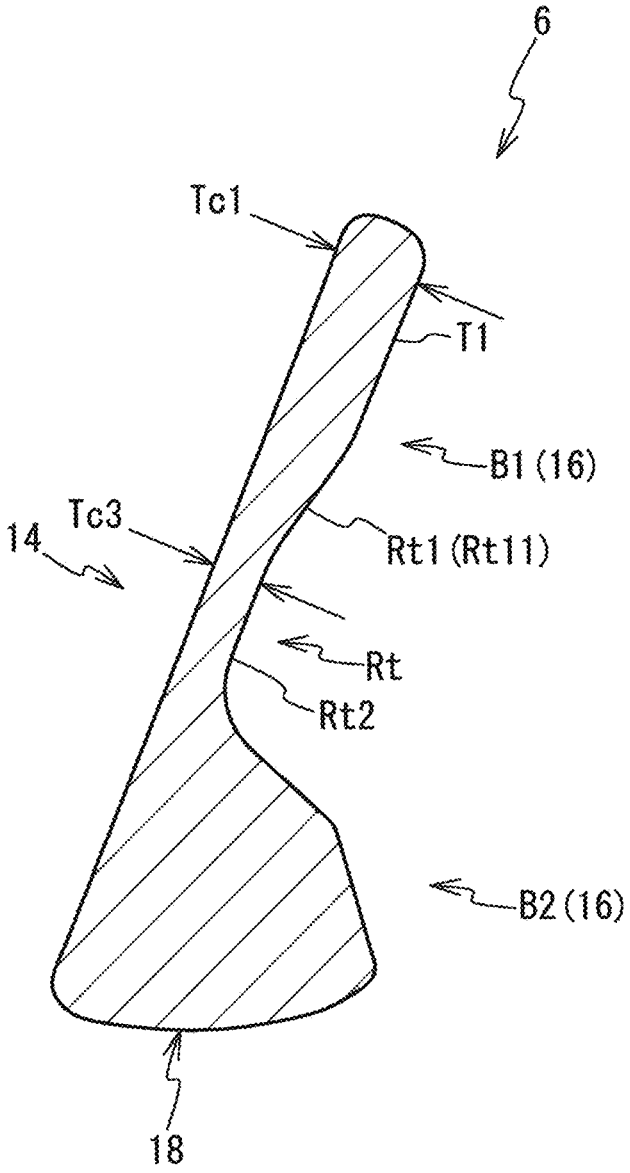
FIG. 6 is a sectional view taken along line A-A of FIG. 2.
Figure 7:
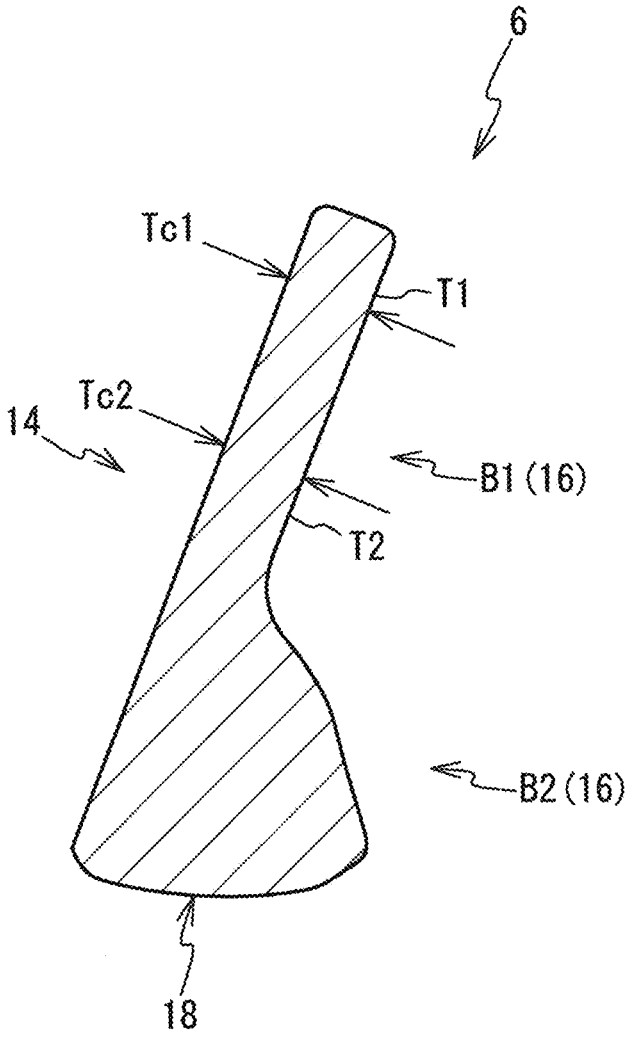
FIG. 7 is a sectional view taken along line B-B of FIG. 2.
Figure 8:
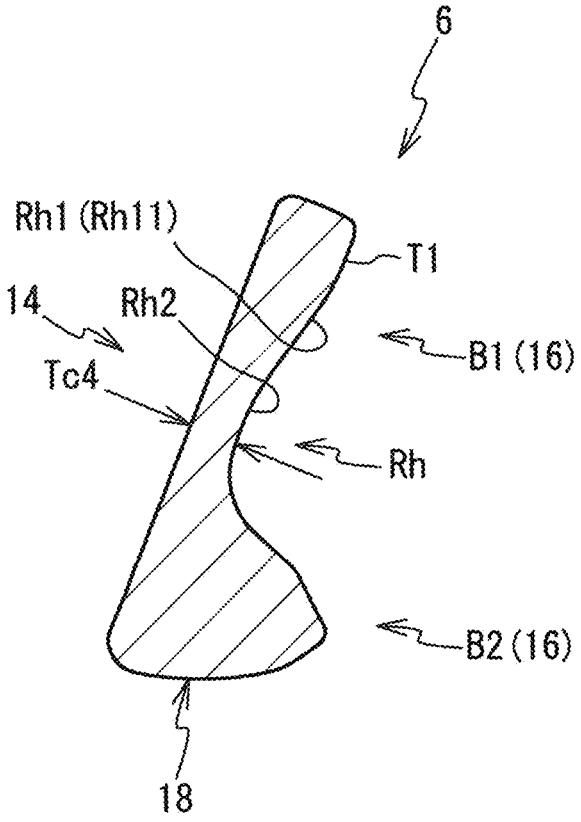
FIG. 8 is a sectional view taken along line C-C of FIG. 2.

FIG. 6 is a sectional view taken along line A-A in FIG. 2. FIG. 6 is the sectional view of the head 6 at the toe reference position Pt. FIG. 7 is a sectional view taken along line B-B in FIG. 2. FIG. 7 is the sectional view of the head 6 at the middle position Pc of the face line. FIG. 8 is a sectional view taken along line C-C in FIG. 2. FIG. 8 is the sectional view of the head 6 at the heel reference position Ph. As shown in FIG. 6 to FIG. 8, the head 6 is solid. In other words, the head 6 does not include a hollow portion. The head 6 does not include an undercut portion, either. The undercut portion in the present application means a portion in which a head section taken along a plane perpendicular to the face surface 14 and parallel to the face line gv is separated into a plurality of parts.

As shown in FIG. 6, on the toe reference position Pt, a point having the minimum head thickness in the top-side region B1 is located on the toe recess part Rt.

As shown in FIG. 7, the head thickness of the first thick portion T1 is equal to the head thickness of the second thick portion T2. The head thickness of the first thick portion T1 may be different from the head thickness of the second thick portion.

As shown in FIG. 8, on the heel reference position Ph, a point having the minimum head thickness in the top-side region B1 is located on the heel recess part Rh.

As shown in FIG. 6 and FIG. 8, the weight of the head 6 is allocated to the upper side and the lower side. The weight of the head 6 is allocated to the upper side (first thick portion T1) and the lower side (sole-side region B2) of the toe recess part Rt (see FIG. 6). The weight of the head 6 is allocated to the upper side (first thick portion T1) and the lower side (sole-side region B2) of the heel recess part Rh (see FIG. 8).

As shown in FIG. 3A and FIG. 3B, the toe recess part Rt includes a toe upper-side surface Rt1, a bottom surface Rt2, and a toe lateral inclined surface Rt3. The bottom surface Rt2 is a plane. The bottom surface Rt2 is parallel to the face surface 14.

The toe upper-side surface Rt1 is formed along the lower edge of the first thick portion T1. The toe upper-side surface Rt1 connects the bottom surface Rt2 and the first thick portion T1. The toe upper-side surface Rt1 forms a thickness transition part that has a gradually changing head thickness. The toe lateral inclined surface Rt3 connects the bottom surface Rt2 and the second thick portion T2. The toe lateral inclined surface Rt3 forms a thickness transition part that has a gradually changing head thickness.

The toe lateral inclined surface Rt3 is located on the toe side of the second thick portion T2. The toe lateral inclined surface Rt3 is adjacent to the second thick portion T2. The toe lateral inclined surface Rt3 is inclined so as to approach the face surface 14 as going to the toe side.

As well shown in FIG. 6, the toe upper-side surface Rt1 includes a toe upper inclined surface Rt11 inclined so as to approach the face surface 14 as going to the lower side. In the present embodiment, the whole toe upper-side surface Rt1 is the toe upper inclined surface Rt11. A part of the toe upper-side surface Rt1 may be the toe upper inclined surface Rt11.

As shown in FIG. 3A and FIG. 3B, the heel recess part Rh includes a heel upper-side surface Rh1, a bottom surface Rh2, and a heel lateral inclined surface Rh3.

The heel upper-side surface Rh1 connects the bottom surface Rh2 and the first thick portion T1. The heel upper-side surface Rh1 forms a thickness transition part that has a gradually changing head thickness. The heel lateral inclined surface Rh3 connects the bottom surface Rh2 and the second thick portion T2. The heel lateral inclined surface Rh3 forms a thickness transition part that has a gradually changing head thickness.

The heel lateral inclined surface Rh3 is located on the heel side of the second thick portion T2. The heel lateral inclined surface Rh3 is adjacent to the second thick portion T2. The heel lateral inclined surface Rh3 is inclined so as to approach the face surface 14 as going to the heel side.

As well shown in FIG. 8, the heel upper-side surface Rh1 includes a heel upper inclined surface Rh11 inclined so as to approach the face surface 14 as going to the lower side. In the present embodiment, the whole heel upper-side surface Rh1 is the heel upper inclined surface Rh11. A part of the heel upper-side surface Rh1 may be the heel upper inclined surface Rh11.

Figure 9:
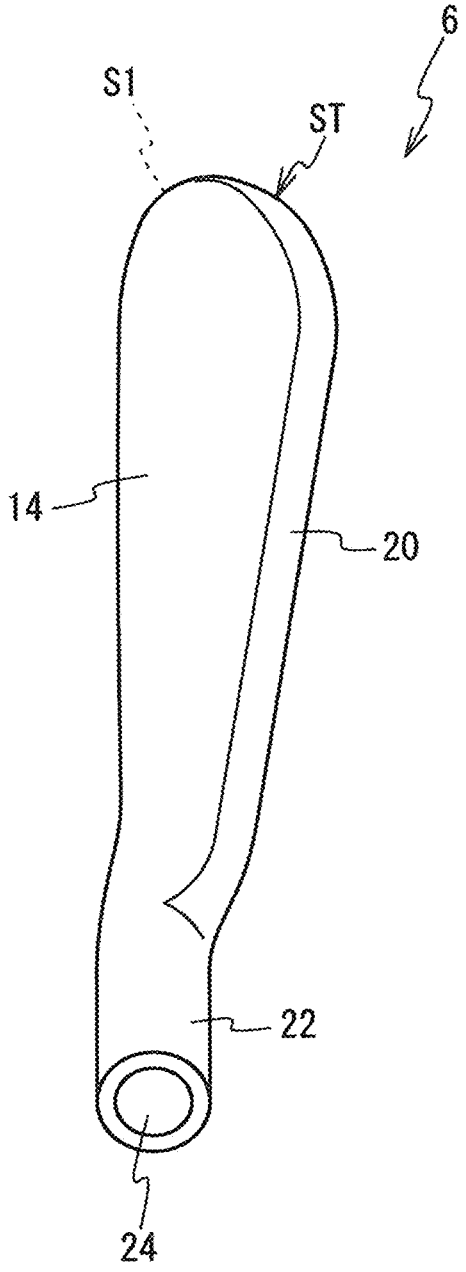
FIG. 9 is a plan view of the head in FIG. 2 as viewed from above.
Figure 10:
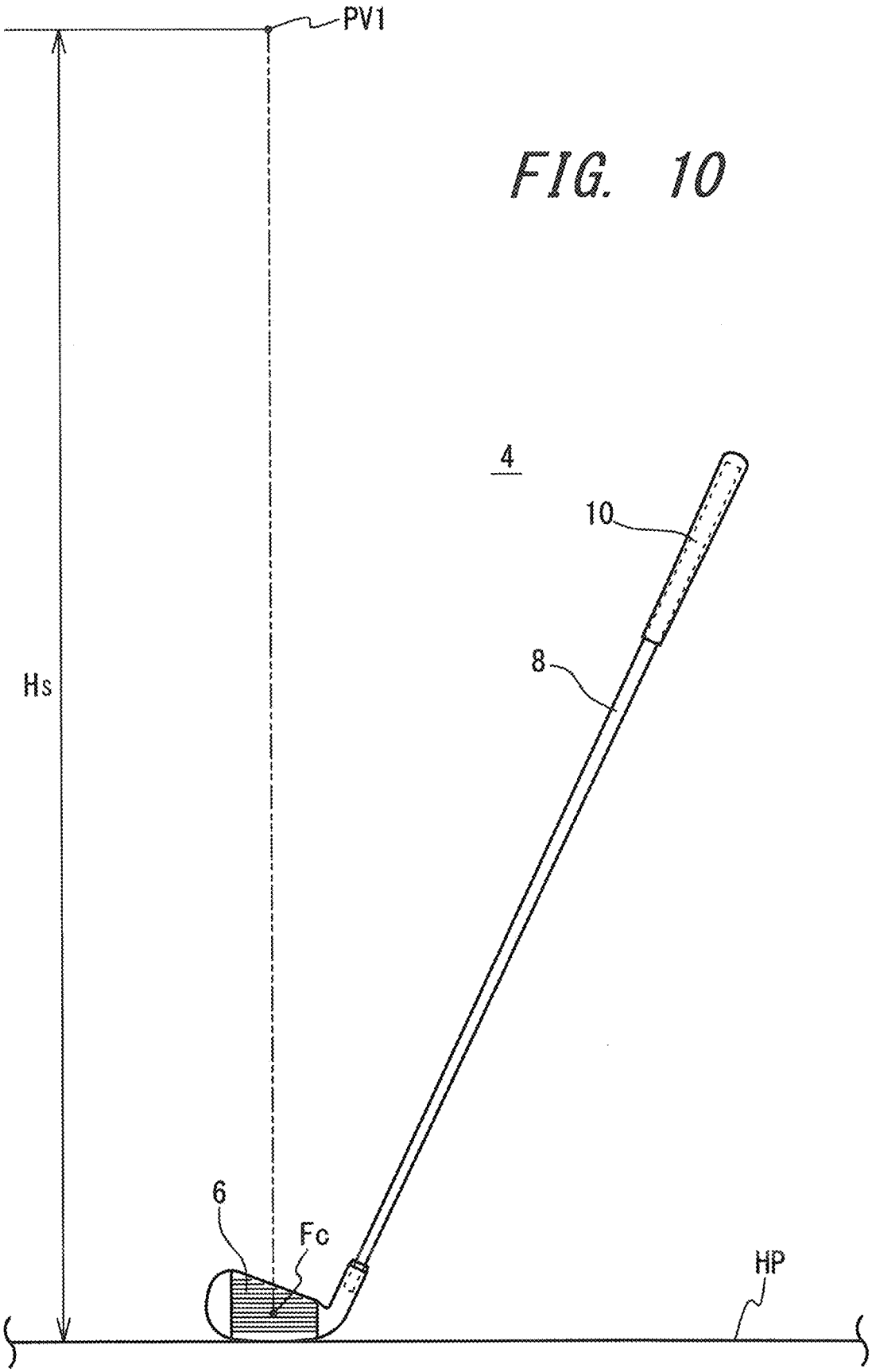
FIG. 10 is a diagram illustrating a reference viewpoint.

FIG. 9 is a plan view of the head 6 in the reference state as viewed from a reference viewpoint. FIG. 10 is a diagram for illustrating the reference viewpoint PV1.

The reference viewpoint PV1 is a term defined in the present application. The reference viewpoint PV1 is located vertically above the head 6 in the reference state. More specifically, the reference viewpoint PV1 is located vertically above the face center Fc. The height Hs of the reference viewpoint PV1 from the horizontal plane HP is set to 1.5 m.

In FIG. 10, the whole golf club 4 is depicted. FIG. 10 shows the golf club 4 in which the head 6 is in the reference state. This position of the golf club 4 is similar to its position in the state of addressing.

The viewpoint of the golf player in addressing is located almost uprightly above the grip 10. This golf player's viewpoint is located obliquely above the head 6 (upper side on the heel side). That is, the golf player's viewpoint in addressing is located obliquely above the head 6. On the other hand, the reference viewpoint PV1 defined in the present application is located uprightly above the head 6. The reference viewpoint PV1 is located on the toe side (left side in FIG. 10) relative to the golf player's viewpoint in addressing.

The reference viewpoint PV1 is set in order to further reliably evaluate how the toe side surface of the head 6 looks in addressing.

As described above, the side recess part S1 is formed in the head 6. Such aside recess part S1 is not formed in a normal iron head. That is, in general, the width of the toe side surface of the head 6 in the top-side region B1 is constant, or is changed so as to increase toward the lower side. The side recess part S1 which is visually recognized in addressing can cause an uncomfortable feeling for golf players who are used to using such a normal head. The head 6 is likely to look to be a strange shape when the side recess part S1 is visually recognized.

It is generally known that swings are strongly affected by the player's state of mind in playing golf. The strange feeling caused by how the head looks in addressing has an effect on the swing. For example, this strange feeling arouses misgivings about the orientation of the face surface 14 in addressing. The misgivings can create anxious feeling upon shots. This anxious feeling can cause disturbance in swing. The strange feeling in addressing can induce a missed shot.

Many of golf players who use a flat back (muscle back) iron or irons similar thereto are professional golf players or advanced-level golf players. These golf players particularly sensitive about how the head 6 looks in addressing.

The head 6 includes the side recess part S1. The side recess part S1, however, is invisible when the head 6 in the reference state is viewed from the reference viewpoint PV1.

As described above, the reference viewpoint PV1 is located on the toe side relative to the golf player's viewpoint in addressing. Therefore, as compared to the golf player's viewpoint in addressing, the reference viewpoint PV1 is located on a point from which the toe side surface of the head 6 is likely to be visible. When the side recess part S1 is invisible from the reference viewpoint PV1, the side recess part S1 is invisible from the golf player's viewpoint in addressing.

The reference viewpoint PV1 is set in order to take variations in locations of golf player's viewpoint in addressing into consideration. Golf players have different heights, different arm lengths, etc. In addition, depending on the golf player, states in addressing (forward-bent angle of the player's upper half body, position of the grip, angle between the player's arm and the club, etc.) are different from each other. Because of the differences, there are variations in golf players' viewpoints in addressing. In light of absorbing the variations, the reference viewpoint PV1 is set. The reference viewpoint PV1 is located at a point from which the toe side surface of the head 6 is more likely to be visible than when viewed from any viewpoints located within the range of the variations. Therefore, the above-mentioned visual effect is reliably brought by setting the reference viewpoint PV1.

When the head 6 in the reference state is viewed from the reference viewpoint PV1, at least apart of the side recess part S1 may be visible. In this case, the toe upper inclined surface Rt11 alleviates the above-mentioned strange feeling. As shown in FIG. 9, when the head 6 is viewed from above, the width of the toe side surface ST of the head 6 is gradually narrowed toward the lower side. The look of the head 6 is similar to the look of a normal head in which the width of the toe side surface ST is constant. In the head 6, the toe upper inclined surface Rt11 reaches the toe side surface ST. By the presence of the toe upper inclined surface Rt11, even if the side recess part S1 is visible, the look of the head 6 becomes similar to the look of the normal head. Therefore, the strange feeling in addressing is reduced. Thus, when the side recess part S1 is visible, the following structure is preferable. Of the side recess part S1, a portion formed by the toe upper inclined surface Rt11 is preferably visible when the head 6 in the reference state is viewed from the reference viewpoint PV1.

Whether or not a specific portion is visible from the reference viewpoint PV1 can be confirmed by an image viewed from the reference viewpoint PV1. This image can be taken by a camera.

Figure 11:
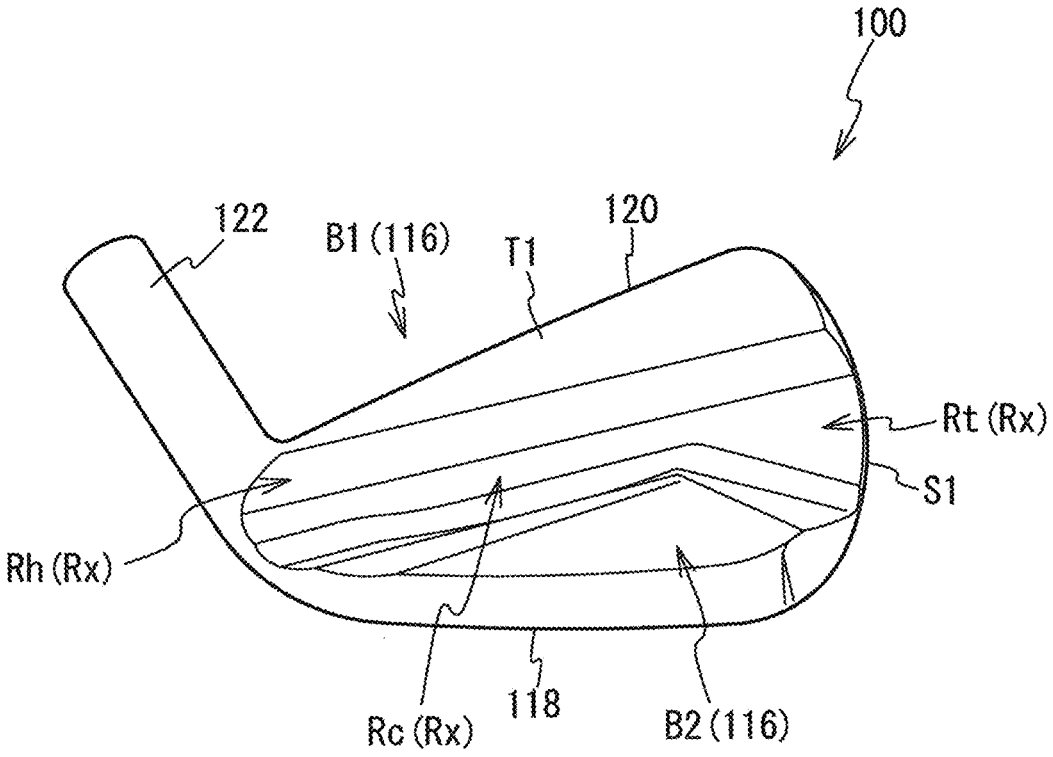
FIG. 11 is a back view of a head according to a second embodiment.

FIG. 11 is a back view of a head 100 according to a second embodiment. The head 100 is the same as the head 6 except for the shape of the back surface.

The head 100 includes a face surface (not shown in the drawing), aback surface 116, a sole surface 118, and a top blade 120. The head 100 further includes a hosel 122.

The top blade 120 constitutes an upper surface of the head 100. The top blade 120 is located on the upper side of the face surface. The top blade 120 is located on the upper side of the back surface 116. The top blade 120 extends between an upper edge of the face surface and an upper edge of the back surface 116.

The back surface 116 includes a top-side region B1 and a sole-side region B2. The top-side region B1 is located on the upper side of the sole-side region B2. The top-side region B1 is located between the sole-side region B2 and the top blade 120. The sole-side region B2 is located on the lower side of the top-side region B1. The sole-side region B2 is located between the top-side region B1 and the sole surface 118.

The top-side region B1 includes a toe recess part Rt and a heel recess part Rh. The top-side region B1 further includes a center recess part Rc. The center recess part Rc is formed between the toe recess part Rt and the heel recess part Rh. Although the second thick portion T2 is provided in the above-described head 6, the head 100 does not includes a second thick portion T2. In the head 100, the second thick portion T2 in the head 6 is replaced with the center recess part Rc.

The center recess part Rc is located in a region including the sweet spot SS. The center recess part Rc is located in a region including the face center Fc.

The toe recess part Rt is continuous with the center recess part Rc. The center recess part Rc is continuous with the heel recess part Rh. The toe recess part Rt, the heel recess part Rh and the center recess part Rc are continuous with each other, thereby forming a continuous recess part Rx extending from the toe side to the heel side. The continuous recess part Rx continuously extends at least from the toe reference position Pt to the heel reference position Ph. The head thickness of the continuous recess part Rx is smaller than the head thickness of the first thick portion T1.

The sectional view of the head 100 at the toe reference position Pt is the same as FIG. 6. The sectional view of the head 100 at the heel reference position Ph is the same as FIG. 8. As shown in these sectional views, the weight of the head 100 is allocated to the upper portion and the lower portion. Furthermore, the center recess part Rc is provided in the head 100. Therefore, also in the middle portion of the head, the weight of the head is allocated to the upper portion and the lower portion.

Figure 12:
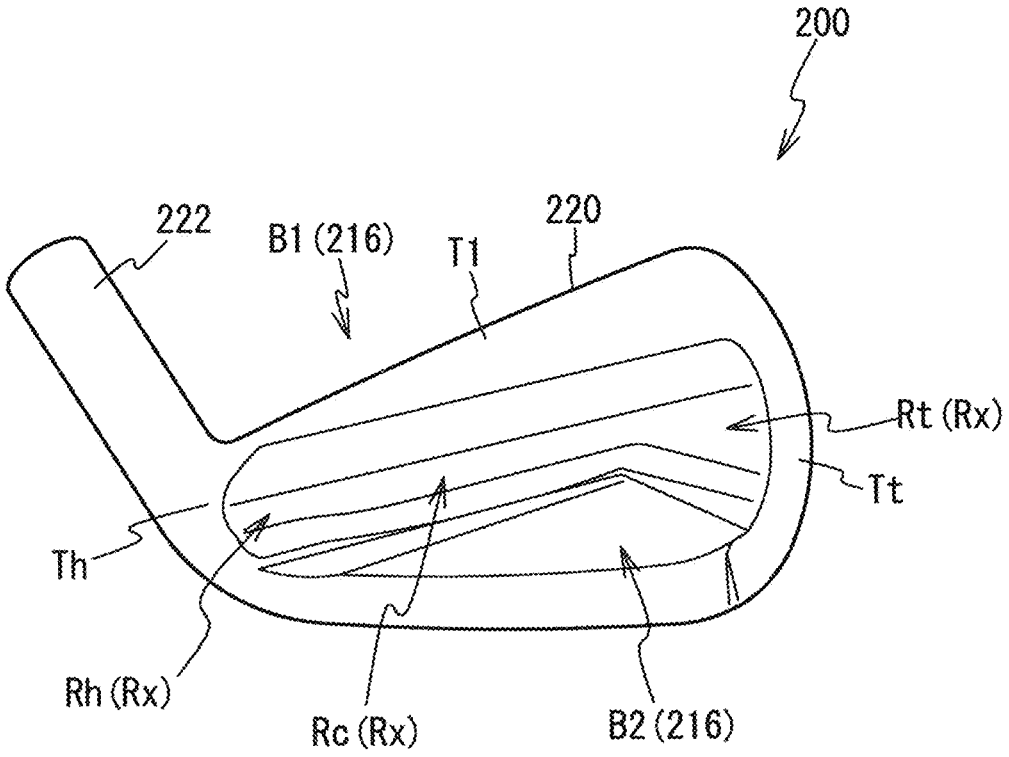
FIG. 12 is a back view of a head according to a third embodiment.

FIG. 12 is a back view of a head 200 according to a third embodiment. The head 200 is the same as the head 6 except for the shape of the back surface.

The head 200 includes a face surface (not shown in the drawing), aback surface 216, a sole surface 218, and a top blade 220. The head 200 further includes a hosel 222.

The top blade 220 constitutes an upper surface of the head 200. The top blade 220 is located on the upper side of the face surface. The top blade 220 is located on the upper side of the back surface 216. The top blade 220 extends between an upper edge of the face surface and an upper edge of the back surface 216.

The back surface 216 includes a top-side region B1 and a sole-side region B2. The top-side region B1 is located on the upper side of the sole-side region B2. The top-side region B1 is located between the sole-side region B2 and the top blade 220. The sole-side region B2 is located on the lower side of the top-side region B1. The sole-side region B2 is located between the top-side region B1 and the sole surface 218.

The top-side region B1 includes a toe recess part Rt and a heel recess part Rh. The top-side region B1 further includes a center recess part Rc. The center recess part Rc is formed between the toe recess part Rt and the heel recess part Rh. Although the second thick portion T2 is provided in the above-described head 6, the head 200 does not include the second thick portion T2.

The center recess part Rc is located in a region that includes the sweet spot SS. The center recess part Rc is located in a region that includes the face center Fc.

The toe recess part Rt is continuous with the center recess part Rc. The center recess part Rc is continuous with the heel recess part Rh. The toe recess part Rt, the heel recess part Rh and the center recess part Rc are continuous with each other, thereby forming a continuous recess part Rx that extends from the toe side to the heel side. The continuous recess part Rx continuously extends at least from the toe reference position Pt to the heel reference position Ph. The head thickness of the continuous recess part Rx is smaller than the head thickness of the first thick portion T1.

The sectional view of the head 200 at the toe reference position Pt is the same as FIG. 6. The sectional view of the head 200 at the heel reference position Ph is the same as FIG. 8. As shown in these sectional views, the weight of the head 200 is allocated to the upper portion and the lower portion. In addition, the center recess part Rc is provided in the head 200. Therefore, also in the middle portion of the head, the weight of the head is allocated to the upper portion and the lower portion.

The back surface 216 (top-side region B1) includes a toe thick portion Tt. The toe thick portion Tt is provided on the toe side relative to the toe reference position Pt. The toe thick portion Tt is provided on the toe side of the toe recess part Rt. The head thickness of the toe thick portion Tt is greater than the head thickness of the toe recess part Rt. A toe-side edge of the toe thick portion Tt forms a part of the edge of the head 200. Because of the presence of the toe thick portion Tt, the toe recess part Rt does not reach the toe-side edge of the head 200 (back surface 216). As a result, the head 200 does not include the above-described side recess part S1.

The back surface 216 (top-side region B1) includes a heel thick portion Th. The heel thick portion Th is provided on the heel side relative to the heel reference position Ph. The heel thick portion Th is provided on the heel side of the heel recess part Rh. The head thickness of the heel thick portion Th is greater than the head thickness of the heel recess part Rh. A heel-side edge of the heel thick portion Th forms a part of an edge of the back surface 216. Because of the presence of the heel thick portion Th, the heel recess part Rh does not reach the heel-side edge of the back surface 216.

Thus, the head 200 includes the toe thick portion Tt and the heel thick portion Th. The head 200 is a head in which the toe thick portion Tt and the heel thick portion Th are added to the head 100.

These embodiments exhibit the following advantageous effects.

In the head 6, the head 100, and the head 200, the toe recess part Rt and the heel recess part Rh are formed. Saved weight produced by providing these recess parts is distributed to the first thick portion T1 or the sole-side region B2. This distribution of the weight increases a up-down MI. Although the head can be rotated due to variations of hitting points in the up-down direction, the increased up-down MI suppresses the rotation. As a result, variations in flight distance are suppressed. The saved weight means a weight removed by forming the recess parts.

Note that the up-down MI means a moment of inertia about a rotation axis that passes through the center of gravity of the head and is parallel to the toe-heel direction. A left-right MI to be described later means a moment of inertia about a rotation axis that passes through the center of gravity of the head and is parallel to the up-down direction.

As described above, variations in hitting points in the up-down direction rotate the head. When a ball collides with the face at a hitting point away from the sweet spot SS, the head is rotated in reaction of the collision. The rotation of the head is conveyed to hands as feeling. The rotation of the head worsens hit feeling. The increased up-down MI suppresses the rotation of the head, whereby the hit feeling is improved.

In a general cavity back iron, a large saved weight caused by the cavity is distributed to the whole circumference of the head, and thus a MI about a shaft axis and a center-of-gravity distance are large. The MI about the shaft axis means a moment of inertia of the head about a rotation axis that is the shaft axis line (center line of the hosel hole). The center-of-gravity distance means a distance between the shaft axis line and the center of gravity of the head.

In such a cavity back iron, the up-down MI and the left-right MI are increased, and thus a sweet area is enlarged. On the other hand, when the MI about the shaft axis and the center-of-gravity distance are large, controllability deteriorates. The controllability means the easiness of operation for closing or opening the face surface. Professional golf players and advanced-level golf players particularly place importance on whether or not they can control the face surface as intended. That is, professional golf players and advanced-level golf players emphasize the controllability.

In the head 6 and the head 100, the weight is redistributed to the upper portion and the lower portion of the head. This redistribution hardly affects the MI about the shaft axis and the center-of-gravity distance. The MI about the shaft axis and the center-of-gravity distance in these heads are similar to those of a general flat back iron. Therefore, a high controllability is maintained. Also in the head 200, the weight distributed to the toe thick portion Tt and the heel thick portion Th is smaller than that of a general cavity back iron. Therefore, the controllability is maintained also in the head 200. Thus, in the respective heads of the above-described embodiments, variations in flight distance cased by variations in hitting points in the up-down direction are suppressed, the hit feeling is improved, and the high controllability is maintained.

In the head 6, the second thick portion T2 is provided. The second thick portion T2 is located in the region including the sweet spot SS. Hitting points are concentrated in the vicinity of the sweet spot SS. The head thickness of the vicinity of hitting points is increased by the second thick portion T2. The second thick portion T2 suppresses deformation and vibration caused by hitting. The second thick portion T2 improves hit feeling.

In the head 6, the second thick portion T2 includes the width changing portion T21. That is, in at least a part of the second thick portion T2, the width of the second thick portion T2 increases toward the sole surface. It has been found that variations in hitting points become large on the sole side relative to the sweet spot SS, through an analysis of hitting points' distribution based on data of actual ball hits by many golf players. Because of the presence of the width changing portion T21, the shape of the second thick portion T2 corresponds to the hitting points' distribution. For this reason, the hit feeling is improved.

A double-pointed arrow WT2 in FIG. 3B shows the minimum value of the toe-heel direction width of the second thick portion T2. In light of hit feeling, WT2 is preferably greater than or equal to 5 mm, more preferably greater than or equal to 10 mm, and still more preferably greater than or equal to 15 mm. In light of increase in the up-down MI, WT2 is preferably less than or equal to 30 mm, more preferably less than or equal to 25 mm, and still more preferably less than or equal to 20 mm.

In the head 6, the head 100 and the head 200, the angle θ1 is smaller than the angle θ2. That is, the lower edge of the first thick portion T1 extends in a direction nearer to a ground surface than the extending direction of the top blade. For this reason, the width of the first thick portion T1 is increased on the toe side, whereby the weight distributed to the first thick portion T1 is increased. As a result, the effect of increasing the up-down MI is further enhanced.

When the lower edge of the first thick portion T1 is inclined upward as going to the toe side, θ1 is defined as a positive value. In the embodiment shown in FIG. 3A and FIG. 3B, the θ1 is the positive value. On the other hand, the lower edge of the first thick portion T1 is inclined downward as going to the toe side, the θ1 is defined as a negative value. θ1 may be a negative value. However, when θ1 is a negative value, the toe recess part Rt is narrowed, and the up-down MI can be reduced. In this respect, θ1 is preferably not a negative value. In light of increase in the up-down MI, θ1 is preferably greater than or equal to 0 degree, and more preferably greater than 0 degree. When θ1 is excessively large, the area of the first thick portion T1 is decreased, and the up-down MI can be reduced. In this respect, θ1 is preferably less than or equal to 20 degrees, more preferably less than or equal to 16 degrees, and still more preferably less than or equal to 12 degrees.

In light of increase in the up-down MI, a difference [θ2−θ1] between the angle θ2 and the angle θ1 is preferably large. In this respect, [θ2−θ1] is preferably greater than or equal to 7 degrees, more preferably greater than or equal to 8 degrees, and still more preferably greater than or equal to 9 degrees. In light of retaining an area for providing the toe recess part Rt, [θ2−θ1] is preferably less than or equal to 16 degrees, more preferably less than or equal to 15 degrees, and still more preferably less than or equal to 14 degrees.

The above-described preferable values for [θ2−θ1] are applicable to [θ2 min−θ1max].

In the head 6, the head 100 and the head 200, the angle θ1 is smaller than the angle θ2. That is, the lower edge of the first thick portion T1 extends in a direction nearer to the ground surface than the extending direction of the top blade. For this reason, the width of the first thick portion T1 is increased on the toe side, whereby the head rigidity on the toe side is enhanced. As a result, although the toe recess part Rt is present, an excessively large deformation of the head in hitting on the toe side is suppressed, and deterioration of hit feeling is suppressed.

Because of the presence of the toe recess part Rt, the side recess part S1 is formed on the toe side surface ST in the head 6 and the head 100. The side recess part S1, however, is disposed on a location that is invisible from the reference viewpoint. Therefore, the contour of the toe side of the head in addressing does not look strange, and the strange feeling does not arise.

In the head 6 and the head 100, the toe recess part Rt includes the toe upper inclined surface Rt11, and the toe upper inclined surface Rt11 forms the side recess part S1. For example, when the toe recess part Rt is disposed on a further upper side, the side recess part S1 can located at a position that is visible in addressing. Even when the side recess part S1 is visible in addressing, the side recess part S1 looks similar to the toe-side end of a normal head because of the presence of the toe upper inclined surface Rt1. For this reason, the strange feeling in addressing is suppressed.

A double-pointed arrow W11 in FIG. 5 shows a width of the toe upper inclined surface Rt11 in the side recess part S1. The width W11 is measured along the up-down direction. In light of suppressing the strange feeling in addressing when the side recess part S1 is visible, the width W11 is preferably greater than or equal to 4 mm, more preferably greater than or equal to 6 mm, and still more preferably greater than or equal to 8 mm. The saved weight produced by forming the toe recess part Rt is preferably large in order to increase the up-down MI. In this respect, the width W11 is preferably less than or equal to 14 mm, more preferably less than or equal to 12 mm, and still more preferably less than or equal to 10 mm.

In the head 6, the head 100 and the head 200, the toe recess part Rt includes the toe upper inclined surface Rt11. The toe upper inclined surface Rt11 suppresses a sharp decrease in the head thickness. Although the toe recess part Rt is likely to be deformed due to a small head thickness thereof, the toe upper inclined surface Rt11 prevents the toe recess part Rt from being excessively deformed. For this reason, even when a hitting point is located in the region of the toe recess part Rt, the hit feeling is good.

In the head 6, the toe recess part Rt includes the toe lateral inclined surface Rt3. The toe lateral inclined surface Rt3 suppresses a shape decrease in the head thickness. Although the toe recess part Rt is likely to be deformed due to its small head thickness, the toe lateral inclined surface Rt3 prevents the toe recess part Rt from being excessively deformed. For this reason, even when a hitting point is deviated to fall on the toe side of the second thick portion T2, the hit feeling is good.

In the head 6, the head 100, and the head 200, the heel recess part Rh includes the heel upper inclined surface Rh11.

The heel upper inclined surface Rh11 suppresses a shape decrease in the head thickness. Although the heel recess part Rh is likely to be deformed due to a small head thickness thereof, the heel upper inclined surface Rh11 prevents the heel recess part Rh from being excessively deformed. For this reason, even when a hitting point is located in a region on the heel thick portion Th, the hit feeling is good.

In the head 6, the heel recess part Rh includes the heel lateral inclined surface Rh3. The heel lateral inclined surface Rh3 suppresses a shape decrease in the head thickness. Although the heel recess part Rh is likely to be deformed due to its small head thickness, the heel lateral inclined surface Rh3 prevents the heel recess part Rh from being excessively deformed. For this reason, when a hitting point is deviated to fall on the heel side of the second thick portion T2, the hit feeling is good.

In the head 100 (FIG. 11), the center recess part Rc is provided instead of the second thick portion T2. For this reason, the up-down MI is further increased. As a result, variations in flight distances caused by variations in hitting points in the up-down direction are suppressed, and furthermore, hit feeling is improved. In the head 200 (FIG. 12), since the toe thick portion Tt and the heel thick portion Th are provided, the left-right MI is also increased in addition to the increased up-down MI. For this reason, not only deviation of the head in the vertical direction but also deviation of the head in the horizontal direction is suppressed.

In light of increasing a weight distributed to the upper portion of the head and enhancing the up-down MI, the head thickness of the first thick portion T1 is preferably greater than or equal to 4.5 mm, more preferably greater than or equal to 4.7 mm, and still more preferably greater than or equal to 4.9 mm. In light of preventing the center of gravity of the head from being an excessively high position, the head thickness of the first thick portion T1 is preferably less than or equal to 6.5 mm, more preferably less than or equal to 6.3 mm, and still more preferably less than or equal to 6.1 mm.

In light of hit feeling, the head thickness of the second thick portion T2 is preferably greater than or equal to 4.5 mm, more preferably greater than or equal to 4.7 mm, and still more preferably greater than or equal to 4.9 mm. In view of restriction on head weight, the head thickness of the second thick portion T2 is preferably less than or equal to 6.5 mm, more preferably less than or equal to 6.3 mm, and still more preferably less than or equal to 6.1 mm.

In light of enhancing the up-down MI, the minimum value of the head thickness in the toe recess part Rt is preferably less than or equal to 3.6 mm, more preferably less than or equal to 3.4 mm, and still more preferably less than or equal to 3.2 mm. In view of the strength of the head, the minimum value of the head thickness in the toe recess part Rt is preferably greater than or equal to 1.8 mm, more preferably greater than or equal to 2.0 mm, and still more preferably greater than or equal to 2.2 mm.

In light of enhancing the up-down MI, the minimum value of the head thickness in the heel recess part Rh is preferably less than or equal to 3.6 mm, more preferably less than or equal to 3.4 mm, and still more preferably less than or equal to 3.2 mm. In view of the strength of the head, the minimum value of the head thickness in the heel recess part Rh is preferably greater than or equal to 1.8 mm, more preferably greater than or equal to 2.0 mm, and still more preferably greater than or equal to 2.2 mm.

The head thickness of the first thick portion T1 is denoted by Tc1 (mm), the head thickness of the second thick portion T2 is denoted by Tc2 (mm), the minimum value of the head thickness in the toe recess part Rt is denoted by Tc3 (mm), and the minimum value of the head thickness in the heel recess part Rh is denoted by Tc4 (mm) (see FIG. 6 to FIG. 8). Hereinafter, a difference [Tc1−Tc3], a difference [Tc1−Tc4], a difference [Tc2−Tc3], and a difference [Tc2−Tc4] are considered.

In light of increase in the up-down MI, [Tc1−Tc3] is preferably greater than or equal to 2.0 mm, more preferably greater than or equal to 2.1 mm, and still more preferably greater than or equal to 2.2 mm. In view of preferable head thickness in each portion, [Tc1−Tc3] is preferably less than or equal to 3.5 mm, more preferably less than or equal to 3.3 mm, and still more preferably less than or equal to 3.1 mm.

In light of increase in the up-down MI, [Tc1−Tc4] is preferably greater than or equal to 2.0 mm, more preferably greater than or equal to 2.1 mm, and still more preferably greater than or equal to 2.2 mm. In view of preferable head thickness in each portion, [Tc1−Tc4] is preferably less than or equal to 3.5 mm, more preferably less than or equal to 3.3 mm, and still more preferably less than or equal to 3.1 mm.

In light of increase in the up-down MI and hit feeling, [Tc2-Tc3] is preferably greater than or equal to 2.0 mm, more preferably greater than or equal to 2.1 mm, and still more preferably greater than or equal to 2.2 mm. In view of preferable head thickness in each portion, [Tc2-Tc3] is preferably less than or equal to 3.5 mm, more preferably less than or equal to 3.3 mm, and still more preferably less than or equal to 3.1 mm.

In light of increase in the up-down MI and hit feeling, [Tc2-Tc4] is preferably greater than or equal to 2.0 mm, more preferably greater than or equal to 2.1 mm, and still more preferably greater than or equal to 2.2 mm. In view of preferable head thickness in each portion, [Tc2-Tc4] is preferably less than or equal to 3.5 mm, more preferably less than or equal to 3.3 mm, and still more preferably less than or equal to 3.1 mm.

The present disclosure can be applied to all iron type golf club heads. An iron type hybrid (iron type utility) golf club head having a plane face surface is included in the iron type golf club heads in the present application.

The above descriptions are merely illustrative examples, and various modifications can be made.

What is claimed is:

1. An iron type golf club head comprising:

a face surface;

a back surface;

a sole surface; and a top blade, wherein the back surface includes a top-side region and a sole-side region located between the top-side region and the sole surface, the top-side region includes a second thick portion located at a face center of the back surface, a toe recess part located on a toe side relative to the second thick portion and extending along a toe inclined surface from the second thick portion to a toe-side edge of the head, a heel recess part located on a heel side relative to the second thick portion and extending along a heel inclined surface from the second thick portion to a heel-side edge of the head, and a first thick portion extending along the top blade above the toe recess part, the second thick portion, and the heel recess part, the first thick portion and the second thick portion each having a thickness, in a direction from the face surface to the back surface, that is thicker than each of a thickness of the toe recess part and a thickness of the heel recess part, and in a reference state in which the head is placed on a horizontal plane, an angle between a lower edge of the first thick portion on the toe side and the horizontal plane is denoted by θ1, an angle between a lower edge of the first thick portion on the heel side and the horizontal plane is equal to θ01, an angle between the top blade and the horizontal plane is denoted by θ2, and the angle θ1 is smaller than the angle θ2.

2. The golf club head according to claim 1, wherein the second thick portion is located in a region that includes a sweet spot.

3. The golf club head according to claim 2, wherein the second thick portion has a head thickness of greater than or equal to 4.5 mm and less than or equal to 6.5 mm.

4. The golf club head according to claim 2, wherein when a head thickness of the second thick portion is denoted by Tc2 (mm), a minimum value of a head thickness of the toe recess part is denoted by Tc3 (mm), and a minimum value of a head thickness of the heel recess part is denoted by Tc4 (mm), a difference [Tc2−Tc3] is greater than or equal to 2.0 mm, and a difference [Tc2−Tc4] is greater than or equal to 2.0 mm.

5. The golf club head according to claim 1, wherein a side recess part is formed on a toe side surface of the head by the reaching of the toe recess part, and the side recess part is invisible when the head in the reference state is viewed from a reference viewpoint located vertically above the head.

6. The golf club head according to claim 5, wherein the reference viewpoint is located vertically above the face center of the head in the reference state, and is located at a height of 1.5 m from the horizontal plane on which the head is placed in the reference state.

7. The golf club head according to claim 1, wherein a side recess part is formed on a toe side surface of the head by the reaching of the toe recess part, at least a part of the side recess part is visible when the head in the reference state is viewed from a reference viewpoint located vertically above the head, the toe recess part includes a toe upper-side surface formed along the lower edge of the first thick portion, and the toe upper-side surface includes a toe upper inclined surface inclined so as to approach the face surface as going to a lower side.

8. The golf club head according to claim 7, wherein the reference viewpoint is located vertically above the face center of the head in the reference state, and is located at a height of 1.5 m from the horizontal plane on which the head is placed in the reference state.

9. The golf club head according to claim 1, wherein when a head thickness of the first thick portion is denoted by Tc1 (mm), a minimum value of a head thickness in the toe recess part is denoted by Tc3 (mm), a minimum value of a head thickness in the heel recess part is denoted by Tc4, a difference [Tc1−Tc3] is greater than or equal to 2.0 mm, and a difference [Tc1−Tc4] is greater than or equal to 2.0 mm.

10. The golf club head according to claim 1, wherein a difference [θ2−θ1] is greater than or equal to 7 degrees and less than or equal to 16 degrees.

11. The golf club head according to claim 1, wherein the first thick portion has a head thickness of greater than or equal to 4.5 mm and less than or equal to 6.5 mm.

12. The golf club head according to claim 1, wherein a minimum value of a head thickness of the toe recess part is greater than or equal to 1.8 mm and less than or equal to 3.6 mm.

13. The golf club head according to claim 1, wherein a minimum value of a head thickness of the heel recess part is greater than or equal to 1.8 mm and less than or equal to 3.6 mm.

14. An iron type golf club head comprising:

a face surface;

a back surface;

a sole surface; and a top blade, wherein the back surface includes a top-side region and a sole-side region located between the top-side region and the sole surface, the top-side region includes a toe recess part located on a toe side relative to a face center, a heel recess part located on a heel side relative to the face center, a first thick portion extending along the top blade and located on an upper side of the toe recess part and on an upper side of the heel recess part, and a second thick portion formed between the toe recess part and the heel recess part, the first thick portion and the second thick portion each having a thickness, in a direction from the face surface to the back surface, that is thicker than each of a thickness of the toe recess part and a thickness of the heel recess part, in a reference state in which the head is placed on a horizontal plane, an angle between a lower edge of the first thick portion on the toe side and the horizontal plane is denoted by θ1, an angle between a lower edge of the first thick portion on the heel side and the horizontal plane is equal to θ1, an angle between the top blade and the horizontal plane is denoted by θ2, and the angle θ1 is smaller than the angle θ2, the toe recess part reaches a toe-side edge of the head, a side recess part is formed on a toe side surface of the head by the reaching of the toe recess part, and the side recess part is invisible when the head in the reference state is viewed from a reference viewpoint located vertically above the head.

15. An iron type golf club head comprising:

a face surface;

a back surface;

a sole surface; and a top blade, wherein the back surface includes a top-side region and a sole-side region located between the top-side region and the sole surface, the top-side region includes a toe recess part located on a toe side relative to a face center, a heel recess part located on a heel side relative to the face center, a first thick portion extending along the top blade and located on an upper side of the toe recess part and on an upper side of the heel recess part, and a second thick portion formed between the toe recess part and the heel recess part, the first thick portion and the second thick portion each having a thickness, in a direction from the face surface to the back surface, that is thicker than each of a thickness of the toe recess part and a thickness of the heel recess part, in a reference state in which the head is placed on a horizontal plane, an angle between a lower edge of the first thick portion on the toe side and the horizontal plane is denoted by θ1, an angle between a lower edge of the first thick portion on the heel side and the horizontal plane is equal to θ1, an angle between the top blade and the horizontal plane is denoted by θ2, and the angle θ1 is smaller than the angle θ2, the toe recess part reaches a toe-side edge of the head, a side recess part is formed on a toe side surface of the head by the reaching of the toe recess part, at least a part of the side recess part is visible when the head in the reference state is viewed from a reference viewpoint located vertically above the head, the toe recess part includes a toe upper-side surface formed along the lower edge of the first thick portion, and the toe upper-side surface includes a toe upper inclined surface inclined so as to approach the face surface as going to a lower side.

* * * * *